US006665965B1

(12) United States Patent
Turchi et al.

(10) Patent No.: US 6,665,965 B1
(45) Date of Patent: Dec. 23, 2003

(54) ERGONOMIC COLOR SAMPLE FAN DECK

(75) Inventors: Mario A. Turchi, Tenafly, NJ (US); Linda K. Trent, Bratenahl, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 10/384,873

(22) Filed: Mar. 7, 2003

Related U.S. Application Data

(60) Provisional application No. 60/439,581, filed on Jan. 10, 2003.

(51) Int. Cl.[7] ..... G09F 7/00

(52) U.S. Cl. ..... 40/492; 40/1; 356/422; 434/98; 434/104

(58) Field of Search ..... 40/492, 124.06, 40/1, 376; 356/421, 422, 423; 434/98, 104

(56) References Cited

U.S. PATENT DOCUMENTS

| | | | | | |
|---|---|---|---|---|---|
| 2,670,844 | A | | 3/1954 | Steinthal | 206/82 |
| 3,950,871 | A | * | 4/1976 | Rege | 40/492 |
| 4,070,775 | A | * | 1/1978 | Brooks | 40/492 |
| 4,104,809 | A | | 8/1978 | Day et al. | 35/28.5 |
| 4,253,259 | A | | 3/1981 | Schaffer et al. | 40/492 |
| D266,543 | S | | 10/1982 | Reiss | D3/30.1 |
| 4,379,696 | A | | 4/1983 | Lerner | 434/98 |
| 4,457,718 | A | | 7/1984 | Lerner | 434/98 |
| D275,337 | S | | 9/1984 | Forcan | D3/30.1 |
| D275,817 | S | | 10/1984 | Keyser | D3/30.1 |
| 5,174,758 | A | | 12/1992 | Abramson | 434/98 |
| 5,358,280 | A | | 10/1994 | Scales | 283/63.1 |
| D357,280 | S | * | 4/1995 | Bechler et al. | D19/64 |
| D366,763 | S | | 2/1996 | Sargent et al. | D5/60 |
| 5,728,427 | A | | 3/1998 | Akkerman et al. | 427/288 |
| 5,803,748 | A | | 9/1998 | Maddrell et al. | 434/317 |
| 5,855,480 | A | | 1/1999 | Housman | 434/75 |
| 5,871,237 | A | | 2/1999 | Hunt | 281/21.1 |
| 6,041,215 | A | | 3/2000 | Maddrell et al. | 434/317 |
| 6,112,665 | A | * | 9/2000 | Teter et al. | 356/421 |
| 6,474,693 | B1 | * | 11/2002 | Nitsche | 40/376 |

* cited by examiner

*Primary Examiner*—Gary Hoge
(74) *Attorney, Agent, or Firm*—Robert E. McDonald; Paul R. Katterle; Vivien Y. Tsang

(57) ABSTRACT

A fan deck display having a case including a center wall joined between a pair of side walls. Each of the side walls has a longitudinal free edge with a plurality of undulations formed therein. A plurality of color strips are movably connected to the case. Each of the color strips has a plurality of color swatches and a free edge with a plurality of undulations formed therein. When the color strips are in a retracted position inside the case, the undulations in the color strips are aligned with the undulations in the free edges.

19 Claims, 3 Drawing Sheets

ERGONOMIC COLOR SAMPLE FAN DECK

CROSS-REFERENCE TO RELATED APPLICATION

This application claims the benefit of U.S. provisional patent application No. 60/439581 filed on Jan. 10, 2003, the entirety of which is hereby incorporated by reference.

BACKGROUND OF THE INVENTION

The present invention is directed to sample display devices and more particularly to color sample fan decks for use in selecting paint colors.

Merchants who sell paint typically provide color samples of their paint to assist customers in selecting paint having a desired color and texture. Conventionally, multiple color samples are arranged on a single piece of heavy paper or cardboard, commonly referred to as a color card or a color strip. In a typical color strip, the color samples comprise small rectangular chips or swatches, each having an area less than about 2 square inches. The swatches are of different colors and are arranged in close proximity to each other on one side of the color strip. Usually, the swatches are different tints and shades of a particular hue. A conventional color strip typically has a length of about 8 to about 10 inches and a width of about 1.5 to about 2 inches.

Color strips are often displayed in a fan deck, wherein the color strips are arranged in a stack disposed between outer cover panels composed of a thin flexible plastic, cardboard or some other semi-rigid material. The color strips are held together between the cover panels by a pin or a rod that extends through aligned openings in the color strips. The color strips may be pivoted along the shaft in a plurality of directions so as to permit the color strips to be fanned out, which permits a large number of the color strips to be viewed at one time.

In conventional fan decks, the outer cover panels do not hold the color strips in place and do not provide much protection for the color strips when the fan deck is being handled or transported. As a result, the color strips often become bent, frayed or otherwise damaged during handling or transportation.

In order to better protect color strips in a fan deck, it has been proposed to enclose the color strips in a case or housing, as disclosed in U.S. Pat. No. 4,104,809 to Day et al., U.S. Des. Pat. No. 266,543 to Reiss, U.S. Des. Pat. No. 275,337 to Forcan and U.S. Des. Pat. No. 275,817 to Keyser. The fan decks disclosed in these patents, however, are rather complicated and do not contain ergonomic features that facilitate the handling of the fan decks.

Based on the foregoing, there is a need in the art for a fan deck that protects paint color strips and has ergonomic features that facilitate the handling of the fan deck. The present invention is directed to such a fan deck.

SUMMARY OF THE INVENTION

It therefore would be desirable, and is an advantage of the present invention, to provide a fan deck that includes a case and at least one color strip. The case includes a center wall joined between a pair of side walls. Each of the side walls has a longitudinal free edge. At least one of the free edges has a plurality of undulations formed therein. The color strip includes at least one color swatch and has a free edge with a plurality of undulations formed therein. The color strip is connected to the case for movement between an extended position, wherein a majority of the color strip is not disposed between the side walls, and a retracted position, wherein a majority of the color strip is disposed between the side walls. When the color strip is in the retracted position, one of the undulations in the color strip is aligned with one of the undulations in the case.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
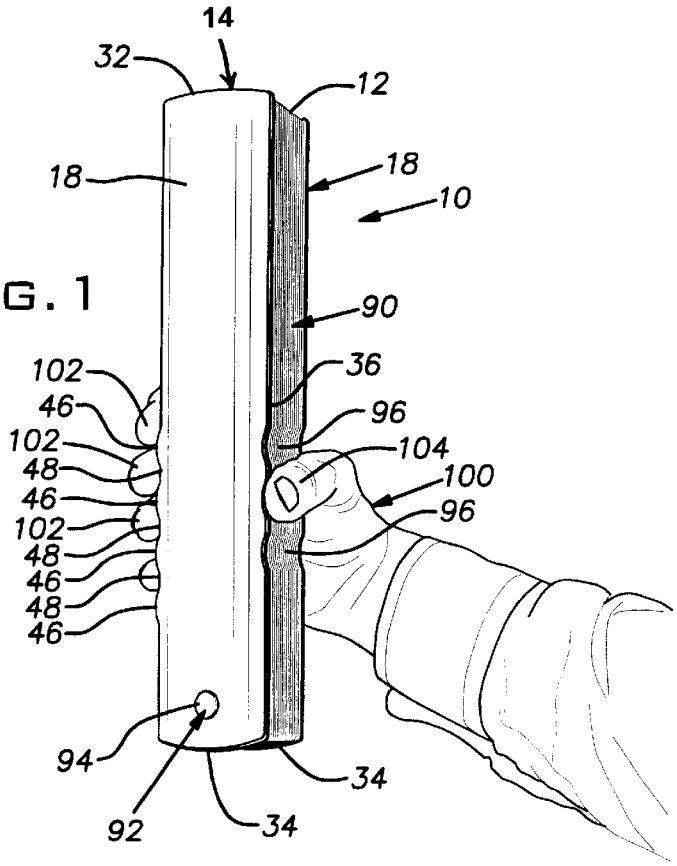
FIG. 1 is a front perspective view of a color sample fan deck comprising a plurality of color strips held in a case, wherein the fan deck is being held by a user.

It should be noted that in the detailed description that follows, identical components have he same reference numerals, regardless of whether they are shown in different embodiments of he present invention. It should also be noted that in order to clearly and concisely disclose the resent invention, the drawings may not necessarily be to scale and certain features of the invention may be shown in somewhat schematic form.

As used herein with regard to a particular coating or paint composition, the terms "dried appearance", "dried color", and "dried finish" shall respectively mean the appearance, color, and finish of the coating or paint composition when dried.

As used herein with regard to the position of one of the color strips 12 relative to the side walls 18 of the case 14, the term "extended position" shall mean a position wherein a majority of the color strip 12 is not disposed between the side walls 18.

As used herein the term "undulation" shall mean one of a series of wavelike bends, curves or elevations.

Referring now to FIGS. 1–5, there are shown various views of a color sample fan deck 10 embodied in accordance with the present invention. The fan deck 10 generally includes a plurality of color strips 12 pivotally held in a case 14. The case 14 is preferably composed of a rigid plastic and generally has a rectangular shape. The case 14 comprises a center wall 16 joined between a pair of side walls 18. The center wall 16 includes a lower undulation portion 20, an upper planar portion 22, a rounded top edge 24, a bottom edge 26 and opposing side edges. An enlarged elliptical opening 28 is formed in the center wall 16 in the planar portion 22, toward the top edge 24. Each of the side walls 18 includes a top edge 32, a bottom edge 34, a free front edge 36 and a rear edge. A pair of aligned holes 40 are formed in the side walls 18 proximate to the bottom edges 34. The top and bottom edges 32, 34 of the side walls 18 are preferably gently curved in the direction between the front edge 36 and the rear edge. T he rear edges of the side walls 18 are joined to the side edges of the center wall 16 at rounded corners 42 (best shown in FIG. 3). The bottom edge 26 of the center wall 16 is spaced upwardly about 1⅜ inches from the bottom edges 34 of the side walls 18 so as to form a pivot space 44 between the side walls 18 in the plane of the center wall 16. The specific dimensions of the case 14 are primarily chosen based on marketing considerations. In a preferred embodiment, however, the side walls 18 each have a length between the top and bottom edges 32, 34 of about 12¼ inches and a width between the front edge 36 and the rear edge of about 2³⁄₁₆ inches, while the center wall 16 has a length between the top and bottom edges 24, 26 of about 10¹¹⁄₁₆ inches and a width between side edges of about 2³⁄₁₆ inches.

Figure 2:
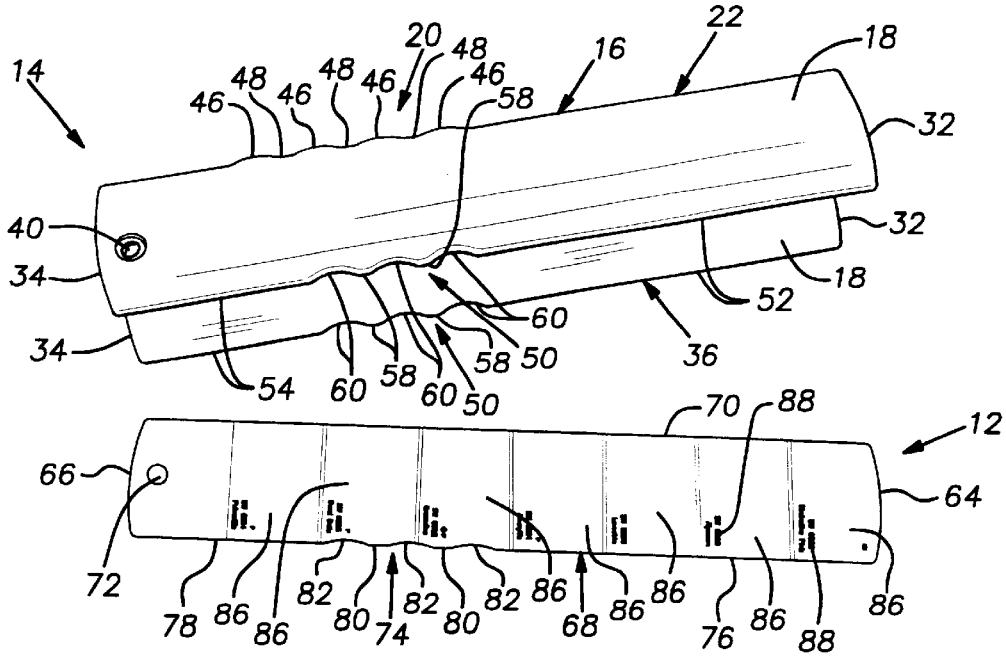
FIG. 2 shows a perspective view of the case and one of the color strips.
Figure 3:
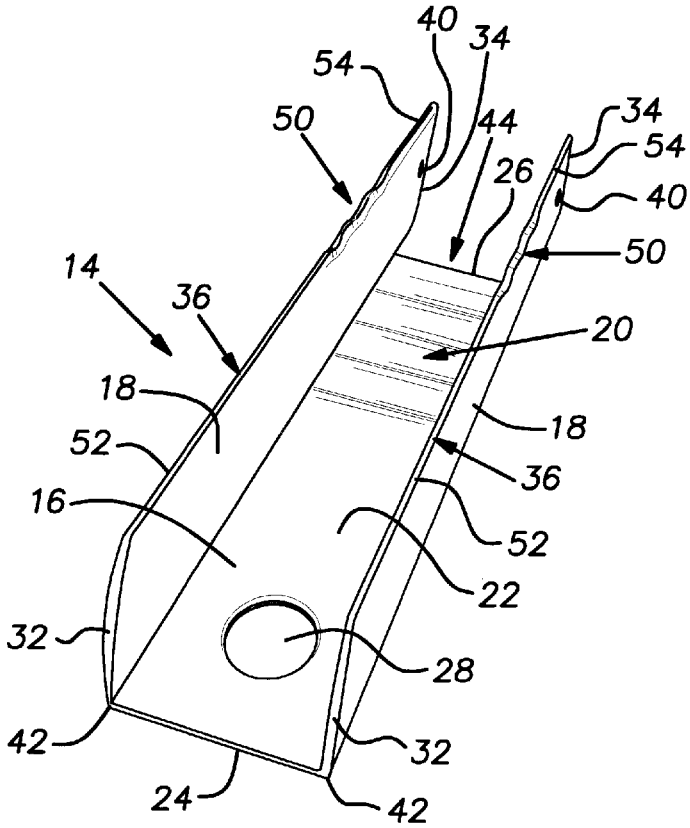
FIG. 3 shows an end perspective view of the case.
Figure 4:
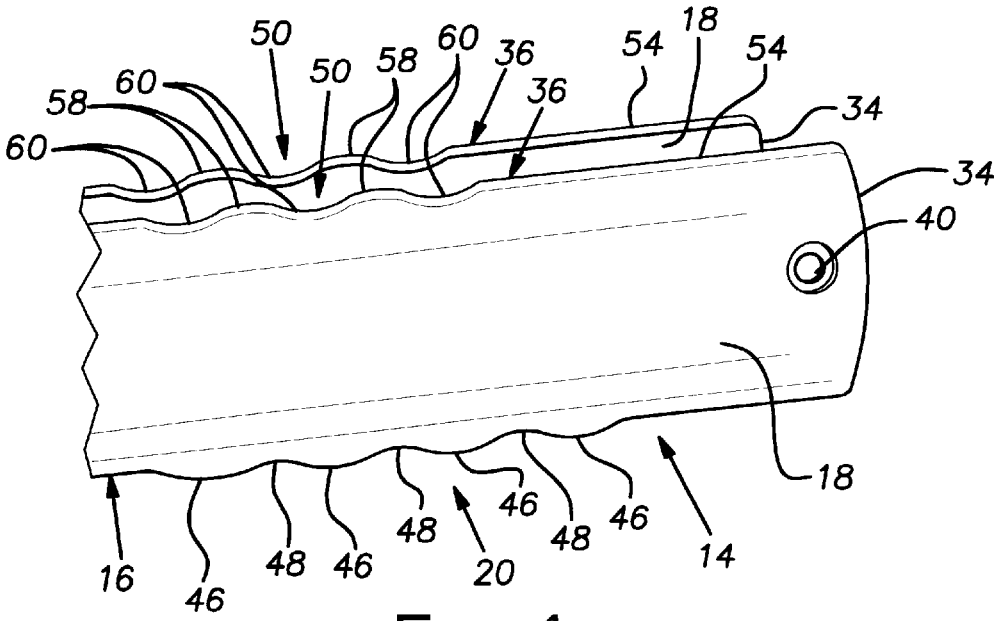
FIG. 4 shows a close up view of undulations in the case.

As best shown in FIGS. 2 and 4, the undulation portion 20 of the center wall 16 includes a plurality of undulations preferably comprising a series of alternating arcuate ridges 46 and grooves or furrows 48. Preferably, there are four ridges 46 separated by three furrows 48. The ridges 46 preferably extend above (or outward from) the planar portion 22 of the center wall 16, while the furrows 48 are preferably coplanar with the planar portion 22. The distance between the centers of ridges 46 is preferably about 1 inch and the distance between the centers of to adjacent furrows 48 is also preferably about 1 inch. The height of each ridge 46, i.e., the outward distance from the planar portion 22 to the top of each ridge 46, is preferably about 0.08 inches. Each furrow 48 is preferably curved and has a radius of curvature of about 0.802 inches. Similarly, each ridge 46 is preferably curved and has a radius of curvature of about 0.802 inches.

Also as best shown in FIGS. 2 and 4, the front edge 36 of each side wall 18 includes an undulation portion 50 disposed between upper and lower straight portions 52, 54. Preferably, the undulation portion 50 is located toward the bottom edge 34 of the side wall 18, i.e., the lower straight portion 54 is shorter than the upper straight portion 52. The undulation portion 50 includes a plurality of undulations preferably comprising a series of alternating arcuate hills 58 and valleys 60. Preferably, there ate three valleys 60 separated by two hills 58. The valleys 60 preferably extend below (or inward from) the upper and lower straight portions 52, 54 of the front edge 36, while the tops of the hills 58 are preferably coplanar with the upper and lower straight portions 52, 54. The distance between the centers of adjacent hills 58 is preferably about 1 inch and the distance between the centers of adjacent valleys 60 is also preferably about 1 inch. The depth of each of the valleys 60, i.e., the distance from the bottom of each valley 60 to the upper and lower straight portions 52, 54, is preferably about 0.08 inches. Each valley 60 is preferably curved and has a radius of curvature of about 0.802 inches. Similarly, each hill 58 is preferably curved and has a radius of curvature of about 0.802 inches. The undulation portions 50 in the side walls 18 are longitudinally aligned, i.e., the hills 58 in the one undulation portion 50 are longitudinally aligned with the hills 58 in the other undulation portion 50 and the valleys 60 in the one undulation portion 50 are longitudinally aligned with the valleys 60 in the other undulation portion 50.

The undulation portion 20 of the center wall 16 is preferably positioned relative to the undulation portions 50 of the side walls 18 such that a lowermost one of the ridges 46 in the center wall 16 is disposed below the undulation portions 50 of the side walls 18, while the remaining ridges 46 of the center wall 16 are longitudinally aligned with the valleys 60 of the side walls 18.

Referring now to FIG. 2, there is shown front plan view of one of the paint color strips 12. Each color strip 12 is generally rectangular in shape and has top and bottom edges 64, 66 and front and rear edges 68, 70. The specific dimensions of each color strip 12 are chosen based on the dimensions of the case 14. Generally, each color strip 12 has a length between the top and bottom edges 64, 66 of about 12.25 inches and a width between the front and rear edges 68, 70 of about 2 inches. The top and bottom edges 64,66 of each color strip 12 are preferably gently curved in the direction between the front and rear edges 68, 70. A hole 72 is formed in each color strip 12 proximate to the bottom edge 66. As will be described more fully below, the holes 72 in the paint color strips 12 are used to mount the color strips 12 in the case 14.

The front edge 68 of each color strip 12 includes an undulation portion 74 disposed between upper and lower straight portions 76, 78. The undulation portion 74 includes a plurality of undulations that are preferably the same in number and preferably have substantially the same dimensions, spacing and shapes as the undulations 50 in the case 14. In this manner, the undulations in the undulation portion 74 preferably comprise a series of alternating arcuate hills 80 and valleys 82 and more particularly three valleys 82 separated by two hills 80. As with the undulation portions 50 in the case 14, the valleys 82 preferably extend below (or inwardly from) the upper and lower straight portions 76, 78 of the front edge 68, while the tops of the hills 80 are preferably coplanar with the upper and lower straight portions 76, 78. The distance between the centers of adjacent hills 80 is preferably about 1 inch and the distance between the centers of adjacent valleys 82 is also preferably about 1 inch. The depth of each of the valleys 82, i.e., the distance from the bottom of each valley 82 to the upper and lower straight portions 76, 78, is preferably about 0.08 inches. Each valley 82 is preferably curved and has a radius of curvature of about 0.802 inches. Similarly, each hill 80 is preferably curved and has a radius of curvature of about 0.802 inches. The undulation portion 74 in each color strip 12 is spaced from the hole 72 such that when the color strips 12 are mounted in the case 14, the undulation portions 74 of the color strips 12 are aligned with the undulation portions 50 of the side walls 18 of the case 14.

Each color strip 12 is comprised of a substrate having a planar front surface with a plurality of rectangular color swatches 86 formed thereon. The color swatches 86 are comprised of different colored coating compositions and are separated by strips of uncoated portions of the substrate. The colored coating compositions preferably cover the front edge of the color strips 12 in the color swatches 86 so as to be visible when the color strips 12 are mounted in the case 14 and are oriented in their fully retracted positions. The colored coating compositions are formulated to have dried colors that are the same as, or substantially similar to, the dried colors of commercially-available paint compositions. In this manner, the color swatches 86 have the same or substantially similar color as the dried colors of commercially-available paint compositions. The dried colors of the commercially-available paint compositions and, thus, the colors of the color swatches 86 may be different tints and shades of a particular hue, or they may be different hues.

The substrate of each color strip 12 may be composed of a cellulosic material, such as thick paper or cardboard, or a polymeric material, such as acrylic coated polypropylene or polyethylene terephthalate. Paper having a thickness of 10 pts. or greater has been found to be useful as the substrate. The colored coating compositions may be solvent-borne coating compositions or latex compositions. A suitable solvent-borne coating composition includes a cellulosederivative resin, such as nitrocellulose, cellulose acetate, ethyl cellulose, or cellulose acetate butyrate, and one or more organic solvents, such as acetone, methylethyl ketone, methyl acetate, methanol, ethanol, and/or nitromethane. A suitable latex composition includes one or more acrylic or vinyl acrylic resins dispersed in an aqueous medium. If the substrate is composed of a cellulosic material, the colored coating compositions are preferably solvent-borne coating compositions. Latex compositions may be used with a cellulosic substrate, however, the cellulosic substrate should be sized to seal its pores against the water in the latex compositions.

The commercially-available paint compositions may be architectural paints, automotive paints, or other types of paint. Since paint color strips are predominately used for architectural paints, the paint color strips 12 find particular utility for use with architectural paints, such as interior and exterior latex house paint.

Although the colored coating compositions and the commercially-available paint compositions have the same or substantially similar colors, the colored coating compositions and the commercially-available paint compositions may have different compositions. For example, the colored coating compositions may be solvent-borne compositions, while the commercially available paint compositions may be latex compositions.

Names and identifying codes 88 for the commercially-available paint compositions are preferably printed on the color strips 12. The names and the identifying codes 88 of the commercially-available paint compositions are used to produce the commercially-available paint compositions at the point of sale. The names and identifying codes 88 may be printed on the front surfaces of the color strips 12, in the corners of the color swatches 86 to which they pertain. The names and identifying codes 88 are also preferably printed on the rear surfaces of the color strips 12, opposite their corresponding color swatches 86.

Conventionally, a merchant who sells paint stocks several different base compositions and a number of different colorant compositions. Most of the commercial paint compositions the merchant offers for sale are a combination of one of the base compositions and one or more colorant compositions, which are mixed together at the point of sale. The amount of base composition and the amount(s) of colorant composition(s) required to produce a particular commercial paint composition are contained in formulas that are stored in a book and/or a computer system located at the merchant's facility. The formulas are identified by the names and/or identifying codes for the commercially-available paint compositions the formulas represent.

Referring back to FIG. 1, the color strips 12 are shown disposed in the case 14. The color strips 12 are aligned together in a stack 90, which is disposed between the side walls 18. With the color strips 12 so positioned, the holes 72 in the color strips 12 are aligned so as to define a passage through the stack 90. A rod (not shown) and a holding pin 92 are provided for securing the color strips 12 to the case 14. The rod has a body with a first end joined to an enlarged head and a second end having a bore formed therein. The bore may be threaded or provided with holding grooves. The holding pin 92 has an enlarged head 94 joined to a body (not shown). The body of the holding pin 92 may be threaded for engagement with threads in the bore or provided with holding structures (such as barbs) for engagement with holding grooves in the bore. The body of the rod extends through the hole 40 in one of the side walls 18 of the case 14 and through the passage in the stack 90. The body of the holding pin 92 extends through the hole 40 in the other side wall 18 and is threaded or press fit into the bore in the second end of the body, thereby securing the holding pin 92 to the rod. In this manner, the head of the rod and the head 94 of the holding pin 92 are disposed against the exterior surfaces of the side walls 18, around the holes 40, with the body of the rod extending therebetween. Since the head of the rod and the head 94 of the holding pin 92 are larger than the holes 40 in the side walls 18, the rod, and, thus the color strips 12 are secured to the case 14.

Figure 5:
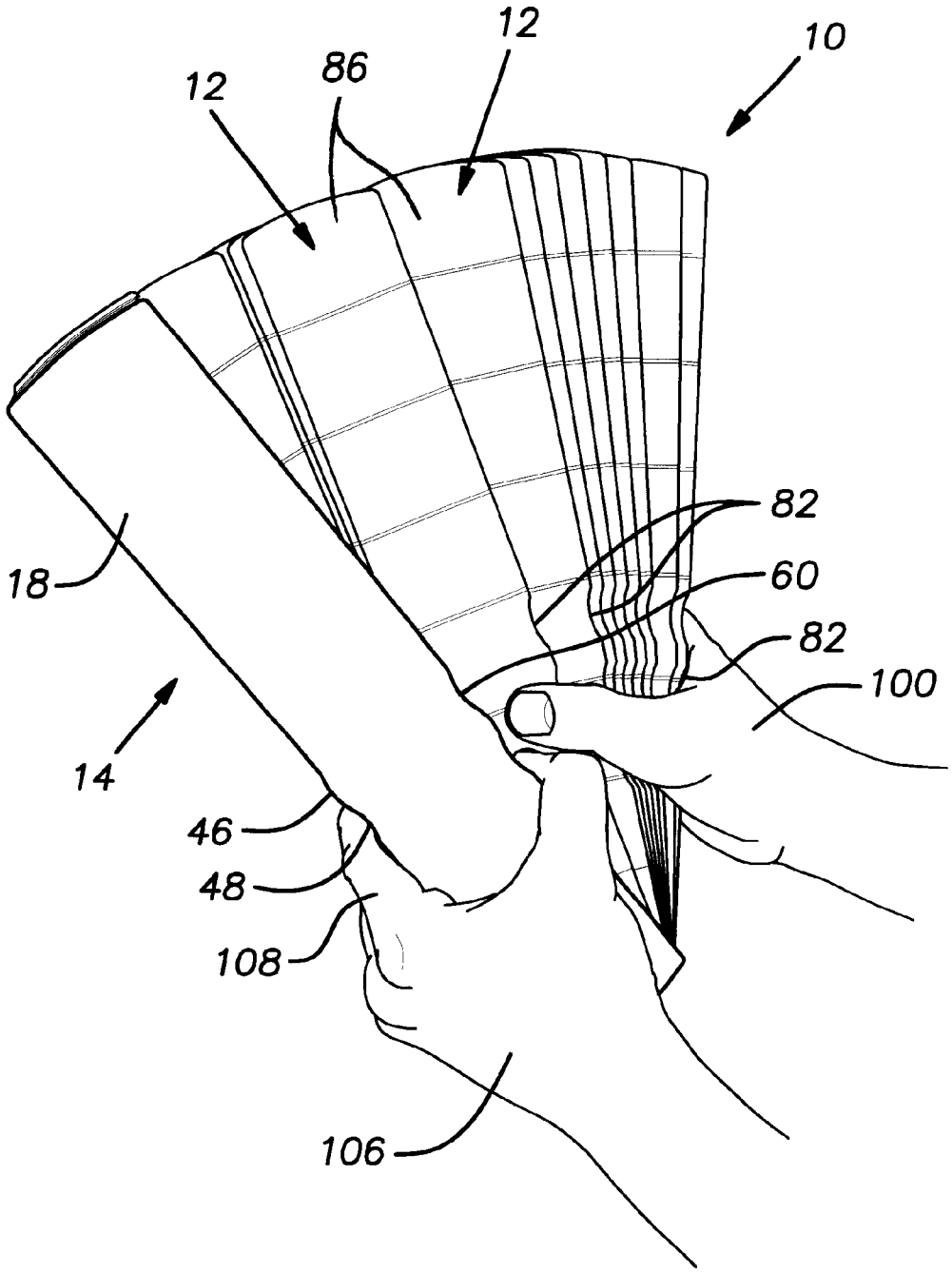
FIG. 5 shows a front perspective view of the fan deck being held by the user with some of the color strips being held in extended positions in a fanned out manner.

With the color strips 12 mounted in the case 14 as described above, each color strip 12 is pivotally movable about 270° between a fully retracted position and a fully extended position. In the fully retracted position, the color strip 12 is fully disposed in the case 14, between and parallel to the side walls 18, with the rear edge 70 of the color strip 12 abutting the center wall 16 of the case 14. In the fully extended position, the color strip 12 extends rearwardly through the pivot space 44 in the case 14 and is disposed at a substantially right angle to the rear surface of the center wall 16, with the front edge 68 of the color strip 12 abutting the bottom edge 26 of the center wall 16. In the fully extended position, most of the color strip 12 is not disposed between the side walls 18. As shown in FIG. 5, a plurality of color strips 12 may be moved to extended positions that are staggered so as to form a fan-like display of the color strips 12.

Referring back to FIG. 1, when all of the color strips 12 are in their fully retracted positions in the case 14, the color strips 12 are aligned together in the stack 90 and the undulation portions 74 of the color strips 12 are aligned with the undulation portions 50 of the side walls 18 of the case 14. The alignment of the undulation portions 74 of the color strips 12 with each other and with the undulation portions 50 of the side walls 18 forms a plurality of grooves 96 that laterally extend through the side walls 18 of the case 14 and the stack 90 of the color strips 12. The grooves 96 and the furrows 48 in the fan deck 10 facilitate the holding of the fan deck 10 by a user. For example, as shown in FIG. 1, a user may comfortably hold the fan deck 10 in a right hand 100 by placing fingers 102 of the right hand 100 in the furrows 48 in the case 14, on one side of the fan deck 10, and placing a thumb 104 of the right hand 100 in one of the grooves 96, on the other side of the fan deck 10.

Referring now to FIG. 5, the fan deck 10 may (in similar fashion) be held in a left hand 106 by placing fingers 108 of the left hand 106 in the furrows 48 in the case 14, on one side of the fan deck 10, and placing a thumb 110 of the left hand 106 in one of the grooves 96, on the other side of the fan deck 10. A plurality of the color strips 12 may be moved from their fully retracted positions to extended positions by inserting a finger 102 of the right hand 100 through the elliptical opening 28 in the center wall 16 of the case 14 and pushing the color strips 12 outwardly. The color strips 12 may then be held in the right hand 100 in extended positions that are staggered so as to form a fan-like display of the color strips 12. When holding the color strips 12 in this manner in the right hand 100, a crook 112 of the right hand 100 may be positioned in in one or more valleys 82 of the color strips 12.

It should be appreciated that the fan deck 10 can similarly be held by a left-handed user.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A fan deck display comprising:

a case comprising a center wall joined between a pair of side walls, each of said side walls having a longitudinal free edge, at least one of the free edges having a plurality of undulations formed therein;

at least one color strip comprising at least one color swatch and having a free edge with a plurality of undulations formed therein, said at least one color strip being connected to the case for movement between an extended position, wherein a majority of the at least one color strip is not disposed between the side walls, and a retracted position, wherein a majority of the at least one color strip is disposed between the side walls; and wherein when the at least one color strip is in the retracted position, one of the undulations in the at least one color strip is aligned with one of the undulations in the case.

2. The fan deck of claim 1, wherein the center wall has a plurality of undulations formed therein, and wherein one of the undulations in the center wall is longitudinally aligned with one of the undulations in the at least one of the free edges of the case.

3. The fan deck of claim 2, wherein the at least one color strip comprises a plurality of color strips, wherein each of the color strips comprises a plurality of undulations.

4. The fan deck of claim 3, wherein one of the undulations in each of the color strips is aligned with one of the undulations in the at least one of the free edges of the case.

5. The fan deck of claim 1, wherein the at least one of the free edges of the case comprises both of the free edges, and wherein each of the free edges of the case comprises a plurality of undulations.

6. The fan deck of claim 5, wherein the at least one color strip comprises a plurality of color strips, wherein each of the color strips comprises a plurality of undulations.

7. The fan deck of claim 6, wherein when the color strips are in their retracted positions, the undulations in the color strips are aligned with the undulations in the free edges of the case so as to define a plurality of laterally-extending grooves in the fan deck.

8. The fan deck of claim 7, wherein the center wall has a plurality of undulations formed therein.

9. The fan deck of claim 8, wherein the undulations in the center wall comprise a series of alternating ridges and furrows, and wherein each of the grooves in the fan deck are longitudinally aligned with one of the furrows.

10. The fan deck of claim 9, wherein the grooves and the furrows in the fan deck each have an arcuate cross-section.

11. The fan deck of claim 1, wherein the at least one color swatch comprises a plurality of color swatches having different colors, and wherein the color swatches have substantially the same color as commercially-available paint compositions.

12. The fan deck of claim 1, wherein the case is composed of a rigid plastic.

13. A fan deck display comprising:

a case comprising:

a pair of side walls, each of said side walls having a longitudinal free edge with a plurality of undulations formed therein a center wall joined between the side walls and having a plurality of undulations formed therein; and at least one color strip comprising at least one color swatch, said at least one color strip being connected to the case for movement between an extended position, wherein a majority of the at least one color strip is not disposed between the side walls, and a retracted position, wherein a majority of the at least one color strip is disposed between the side walls.

14. The fan deck of claim 13, wherein the at least one color strip comprises a plurality of color strips, and wherein each of the color strips comprises a plurality of undulations.

15. The fan deck of claim 14, wherein an enlarged hole is formed in the center wall of the case, said hole being sized to receive a finger therethrough for pushing the color strips outwardly, toward their extended positions.

16. The fan deck of claim 15, wherein when the color strips are in their retracted positions, the undulations in the color strips are aligned with the undulations in the free edges of the case so as to define a plurality of laterally-extending grooves in the fan deck.

17. The fan deck of claim 16, wherein the undulations in the center wall of the case comprise a series of alternating ridges and furrows, and wherein each of the grooves in the fan deck are longitudinally aligned with one of the furrows.

18. The fan deck of claim 13, wherein the at least one color swatch comprises a plurality of color swatches having different colors, and wherein the color swatches have substantially the same color as commercially-available paint compositions.

19. The fan deck of claim 13, wherein the case is composed of rigid plastic.

* * * * *